United States Patent [19]

Marshall

[11] 4,223,783

[45] Sep. 23, 1980

[54] PACKAGING MEANS

[76] Inventor: Nickolas J. Marshall, P.O. Box 210, Lincoln Park, Mich. 48146

[21] Appl. No.: 33,377

[22] Filed: Apr. 26, 1979

Related U.S. Application Data

[63] Continuation-in-part of Ser. No. 893,810, Apr. 26, 1978, abandoned.

[51] Int. Cl.[3] ..... B65D 5/50

[52] U.S. Cl. ..... 206/45.14; 206/373; 206/382; 206/805; 206/225; 150/52 R; 150/52 C

[58] Field of Search ..... 150/52 C, 52 K, 52 R; 206/373, 225, 382, 45.14, 805; 160/377; 190/43

[56] References Cited

U.S. PATENT DOCUMENTS

| | | | |
|---|---|---|---|
| 281,964 | 7/1883 | Brent | 160/377 |
| 483,198 | 9/1892 | Acheson | 190/43 |
| 1,264,264 | 4/1918 | Brewer | 150/52 R |
| 1,444,522 | 2/1923 | Pedlar | 160/377 |
| 1,973,114 | 9/1934 | Sherman | 150/52 R |
| 2,819,901 | 1/1958 | Mateja | 160/377 |
| 2,915,177 | 12/1959 | Flood | 206/460 |
| 3,186,333 | 6/1965 | Hoffman et al. | 206/805 |
| 4,151,913 | 5/1979 | Freitag | 206/382 |

FOREIGN PATENT DOCUMENTS

| | | | |
|---|---|---|---|
| 1141803 | 2/1969 | United Kingdom | 150/52 C |

*Primary Examiner*—Joseph Man-Fu Moy
*Attorney, Agent, or Firm*—Charles W. Chandler

[57] ABSTRACT

Packaging means for storing, mailing or transporting a plurality of small objects having pointed ends. The package has a sheet of compressible foam material having a plurality of tapes attached to one face of the sheet for receiving the pointed objects to a stored position in which the points are embedded in the foam. The foam sheet is rolled into a scroll and maintained in position by a pair of rods, connected to opposite ends of the sheet, which are tied together.

5 Claims, 3 Drawing Figures

PACKAGING MEANS

REFERENCE TO CO-PENDING APPLICATIONS

This application is a continuation-in-part of my pending application Ser. No. 893,810 having a filing date of April 26, 1978, now abandoned.

BACKGROUND OF THE INVENTION

This invention is related to means for storing and transporting a plurality of small, pointed objects or items of jewelry and the like, and in particular a sheet of foam plastic which is rolled in a manner of a scroll to protect the items stored within the scroll.

It is frequently desirable to store or transport a plurality of small items, such as jewelry, in such a manner that they do not come in contact with one another in transit. Other pointed items, such as fishing equipment and certain electronic elements present a problem unless stored or shipped so as to protect their points.

SUMMARY OF THE INVENTION

The purpose of the present invention is to provide a packaging device useful for transporting a plurality of relatively small items, such as jewelry or pointed objects, comprising a sheet of compressible plastic foam having a pair of rods connected to opposite side edges of the sheet so that it can be rolled in a manner of a scroll. The objects are fastened to a plurality of tapes attached to the inner face of the sheet. The tapes provide means for embedding the pointed objects to protect the points, and to maintain the objects in position when the foam sheet is unrolled.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
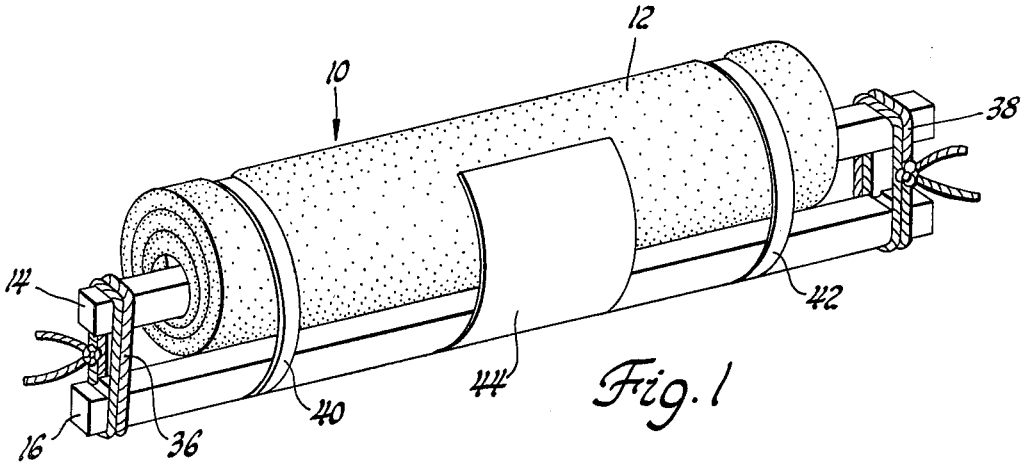
FIG. 1 is a perspective view illustrating the preferred packaging device rolled into a scroll with the rods tied together.

Referring to the drawing, a preferred packaging means, generally indicated at 10, comprises a sheet of a resilient, compressible foam material 12, preferably about one-half inch thick. The length and width of the material can be varied to accomodate the particular packaging problem. For purposes of illustration, sheet 12 has a width of eighteen inches and a length of twenty-four inches.

Rod 14 is fastened along one edge of sheet 12 and a second rod 16 is fastened to the opposite edge of sheet 12. Rods 14 and 16 each have a similar length and extend beyond the side edges of sheet 12. Rod 14 has a notch 18 adjacent one end, and a second notch 20 adjacent its opposite end. Similarly, rod 16 has a notch 22 adjacent one end and a second notch 24 adjacent its opposite end.

Figure 2:
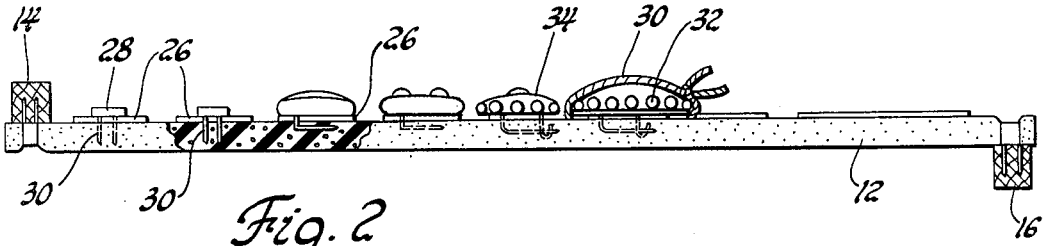
FIG. 2 illustrates the foam sheet unrolled.
Figure 3:
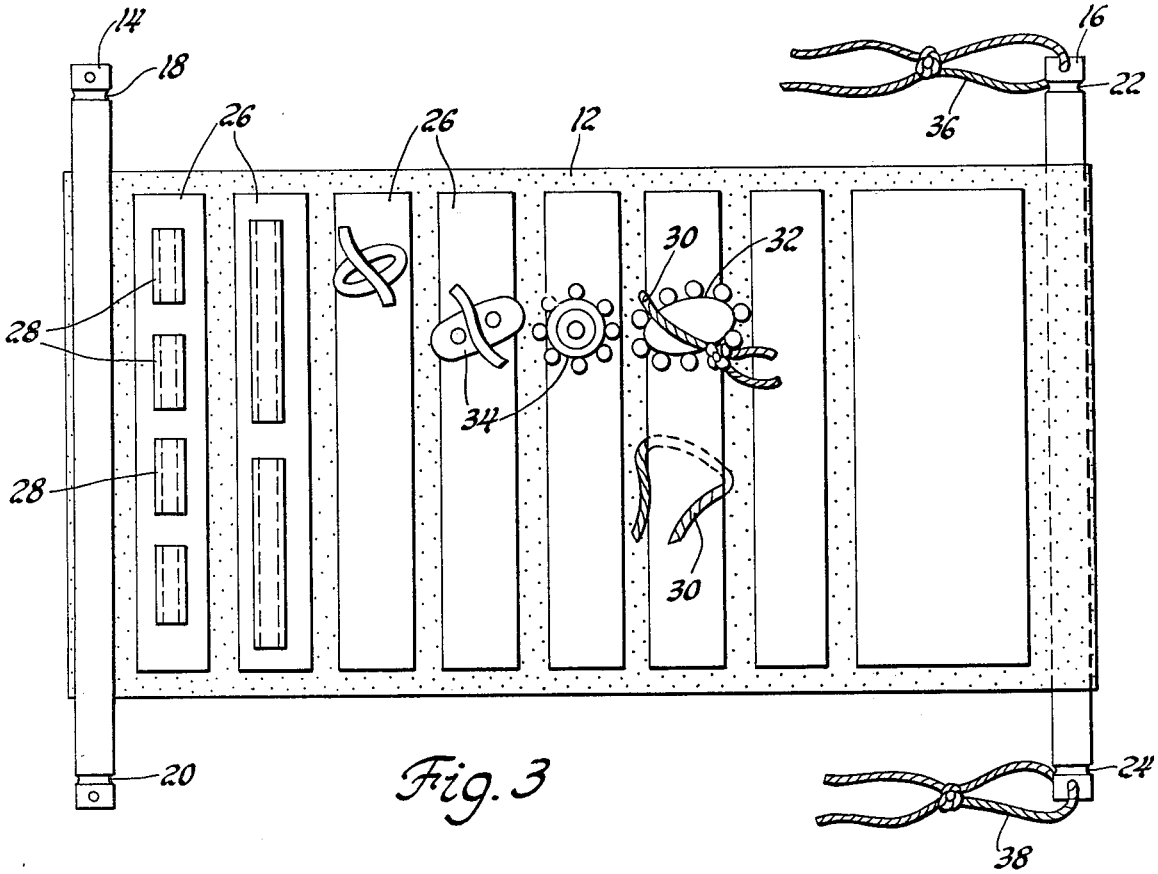
FIG. 3 is a plan view of the foam sheet showing the tapes mounted on one face.

A plurality of paper tapes 26 having an adhesive on one face thereof, are fastened to one face of sheet 12, as illustrated in FIGS. 2 and 3. Tapes 26 are parallel to one another and each has a length slightly less than the width of the sheet.

As illustrated in FIG. 2, the paper tapes provide means for mounting a plurality of small objects. For example, small electronic elements 28 having pointed ends 30 can be mounted on the tapes with their ends penetrating the tapes and extending into the foam material, as illustrated in FIG. 2. The adhesive on the tape adheres to the pointed ends to anchor them in position.

Individual items can be separated and maintained in position without causing damage in transit. The points of the individual items are protected because they are embedded in the foam. The tape helps to support the pointed objects and prevents their accidental removal from the foam when sheet 12 is unrolled. In addition, the tape can be marked with a suitable marking instrument to identify individual items.

The tape can be employed for attaching string 30 for tying items of jewelry 32 in position. In this arrangement, the foam functions to protect the jewelry from being damaged. Other pointed objects, such as fishing lures 34, can be readily mounted on the tapes and then removed for use. The foam floats in water and thus provides means for preventing loss of the fishing objects.

Thus, depending upon the nature of the items being transported or stored, the foam sheet provides means for protecting the points of pointed objects, protecting jewelry from damage, and protecting items of fishing equipment.

The sheet can be rolled into a scroll-like arrangement by rolling rod 16 toward the tapes to house the objects embedded in the foam in a manner illustrated in FIG. 1. As rod 16 is being rolled, the user slightly compresses the foam to form a tight roll. When the sheet has been fully rolled, string means 36 and 38 are tied around the slots of the rods. In this arrangement, the rods provide means for stiffening the foam sheet so that it can be readily handled.

A pair of stapled resilient bands 40 and 42 are mounted adjacent the ends of the foam to prevent the loss of any loose objects contained within the sheet. When the sheet is fully rolled and tied together as illustrated in FIG. 1, the user can attach mailng label 44 on the sheet over rod 18 for use as a mailing label and for sealing the package.

The preferred packaging means is also useful for other pointed objects such as tacks, pins, needles, and broaches, as well as jewelry and fishing lures. It is also useful for non-pointed objects such as protecting fragile canvas pictures and the like for storage, safe keeping or shipping.

Having described my invention, I claim:

1. The combination comprising:

a plurality of objects having pointed ends;

a generally rectangular sheet of resilient, compressible foam material having a thickness sufficient to embed the points of said pointed ends, and first and second end edges connecting a pair of side edges;

a plurality of closely spaced, parallel strips of tape, and an adhesive material on a first side of each of said tapes for fastening the tape to a first side of the sheet of foam material such that the adhesive is disposed between the tape and said sheet whereby the pointed ends of the pointed objects are each receivable through the tape and the adhesive material into the foam material so as to be anchored in position;

a first rod fastened along the first end edge of the sheet so as to extend beyond the side edges thereof;

a second rod fastened along the second end edge of the sheet, so as to extend beyond the side edges thereof, parallel to said first rod and to said strips of tape; and a first string means connecting one end of the first rod to a corresponding end of the second rod, and second string means for connecting the opposite end of the first rod to the corresponding opposite end of the second rod such that said sheet can be rolled around the first rod in the manner of a scroll to enclose the tapes and said objects mounted on the first side of said sheet.

2. A combination as defined in claim 1, including a resilient band member fastened to the second rod and embracing the rolled sheet to prevent removal of said pointed objects from a stored position in said rolled sheet.

3. A combination as defined in claim 1, in which said tape is fastened in a plurality of parallel rolls between said rods.

4. A combination as defined in claim 1, in which said string means is attached to the first rod and the second rod has a groove for receiving the string such that when the sheet is rolled into a scroll, the sheet is compressed as the two rods are moved toward one another.

5. A combination as defined in claim 1, in which the first rod is fastened to the first side of said sheet, and the second rod is fastened to the opposite side of said sheet.

* * * * *